US005323975A

United States Patent [19]

Fulghum, Jr.

[11] Patent Number: 5,323,975

[45] Date of Patent: Jun. 28, 1994

[54] WOOD CHIPPING APPARATUS

[75] Inventor: Oscar T. Fulghum, Jr., Augusta, Ga.

[73] Assignee: Fulghum Industries, Inc., Wadley, Ga.

[21] Appl. No.: 25,337

[22] Filed: Mar. 3, 1993

[51] Int. Cl.[5] ..... B02C 18/18

[52] U.S. Cl. ..... 241/92; 144/176

[58] Field of Search ..... 241/92, 81; 144/176, 144/162 R

[56] References Cited

U.S. PATENT DOCUMENTS

| | | | |
|---|---|---|---|
| 3,069,101 | 12/1962 | Wexell . | |
| 3,570,773 | 3/1971 | Schneider | 241/81 |
| 3,905,558 | 9/1975 | Gaitten | 241/92 X |
| 4,135,563 | 1/1979 | Maucher | 144/172 X |
| 4,140,281 | 2/1979 | Fulghum, Jr. et al. . | |
| 4,240,588 | 12/1980 | Fulghum, Jr. . | |
| 4,827,989 | 5/1989 | Strong | 241/92 X |

FOREIGN PATENT DOCUMENTS

| | | | |
|---|---|---|---|
| 25038 | 1/1906 | Austria | 241/92 |

*Primary Examiner*—Mark Rosenbaum
*Assistant Examiner*—Frances Han
*Attorney, Agent, or Firm*—Cushman, Darby & Cushman

[57] ABSTRACT

A wood chipping apparatus which includes a substantially closed chipping area for capturing and chipping slivers. The chipping apparatus includes a rotating cutting disk and a first anvil whereby most wood is chipped. Wood that is chipped passes through slots in the cutting disk to the discharge side of the apparatus. A second anvil or wear plate and an outer containing wall form, with the housing, the disk and the first anvil, a substantially closed compartment adjacent to, but downstream of, the first anvil. Wood parts that escape chipping by the first anvil and pass between the first anvil and the disk are trapped in the compartment until they are chipped by rotating blades which define, together with the disk and one side of the compartment.

14 Claims, 3 Drawing Sheets

WOOD CHIPPING APPARATUS

BACKGROUND OF THE INVENTION

1. Field of the Invention

This invention relates to an apparatus for chipping large pieces of wood such as logs into small chips and, in particular, to a wood chipper which captures and chips oversized wood pieces, so-called slivers, which are not initially chipped.

2. Description of the Related Art

Conventional wood chipping machines are exemplified by the disclosure of U.S. Pat. No. 3,069,101 to Wexell. Such machines have a horizontal axis about which a cutter disk rotates. A housing surrounds the rotating disk and there is generally one or more infeed chutes through which wood is fed to contact, and be chipped by, cutting blades mounted on the cutter disk. There is also one or more means for outputting the chipped wood from the housing. Typically, chips are blown from the chipper by air which is forced through an exhaust chute, although they may simple drop to a conveyor below the cutter disk.

The cutter disk has a plurality of straight slots, each extending radially from near the center of the disk towards the periphery of the disk. A cutting blade is mounted to one side of the disk adjacent each slot. The cutting blade extends the length of the slot and its cutting edge protrudes from the surface of the disk. The side of the disk having the protruding cutting edges is the front or cutting side of the disk which contacts and chips, incoming logs or other wood parts. As a rotating blade contacts a log, the blade slices the wood, forming chips which pass through the respective slot in the disk to the back side of the disk referred to as the discharge side, where the chip is blown or otherwise removed from the chipper housing.

The logs to be chipped are infed by a conveyor or other means until the log contacts the disk. Typically, the logs or wood pieces are not infed at an angle perpendicular to the surface of the disk, but rather at an acute angle thereto, so they generally are directed towards the vertical axis of the disk. The logs contact the cutting disk and the blades of the disk slice off chips from the end of the log. The chips are severed from the log by the blades of the disk as they pass a stationary anvil or wear plate. The anvil or wear plate is attached to an anvil support which extends from the housing or interior side of the infeed chute towards the cutter disk. The anvil or wear plate edge extends from the support so that there is only a small gap between the anvil edge and the rotating blades of the cutting disk, thus defining a cutting interface between the blades and the anvil. The gap between the anvil and the blades is generally about 0.0001 to 0.00005 of an inch. The anvil edge acts as a cutting surface for the rotating blades to cut against. The chipper is self feeding in that the impact and cutting action of each successive blade pulls the log or wood pieces to the disk so as to be in position for the next cutting blade.

Occasionally, instead of properly severing chips from the log, the cutting blade will draw a sliver of wood past the anvil through the small gap between the anvil and the cutting blades. The sliver is typically of the relatively tough wood from the outer surface of the log, just under the bark. This tough wood tends to split from the side of the log and be pulled through the gap between the anvil and blades rather than be properly cut by the blades. The resulting slivers are often considerably thicker than the width of the gap due to the deformability of the wood and possibly deflection of the disk. The sliver may be up to ⅛ of an inch thick and may be as much as a few feet long because the blades can successively and continuously draw the unchipped sliver through the blade/anvil gap. Once a piece of wood passes between the anvil and the knit it is inside the housing and can freely move to the discharge side of the disk. The large unchipped slivers can then be exhausted with the other chipped material. The result is that the chips created from the logs are contaminated with oversize slivers which must be later separated and separately rechipped or otherwise processed further.

With conventional chippers there is no way to prevent large unchipped slivers from becoming mixed with the desirable wood chips.

SUMMARY OF THE INVENTION

It is therefore an object of this invention to provide an improved wood chipping machine which captures unchipped portions of wood such as slivers before they become mixed with the desirable chips. Thus, providing a more efficient chipping machine which reduces operation costs.

It is further an object of this invention to provide a chipping machine which automatically chips the unchipped slivers and the like to facilitate subsequent classification and minimize rechipping. The foregoing and other objects are realized by defining a substantially closed compartment behind the first anvil, such that when slivers are drawn through the gap between the cutting disk and the anvil, the slivers will be contained in the closed compartment until eventually properly chipped by the blades. The closed compartment is defined by the housing wall on one side and the rotating cutting disk on the other side. The compartment is bounded by the first anvil at one edge and by a second radial anvil or wear plate at a second edge. The circumferential perimeter of the compartment is bounded by a curved member which extends from the housing toward the disk, radially outside the blades. The slivers which pass into the compartment are contained and are subjected to a second chipping action by the rotating cutting blades which cut against the second wear plate or anvil. Thus the slivers are contained within the compartment until they are chipped into smaller, more desirable sizes.

Other objects, features and characteristics of the present invention as well as the methods of operation and functions of the related elements of structure, and the combination of parts and economies of manufacture, will be more apparent upon consideration of the following description and the appended claims with reference to the accompanying drawings, all of which form a part of this specification, wherein like reference numerals designate corresponding parts in the various Figures.

DETAILED DESCRIPTION OF THE INVENTION

Figure 1:
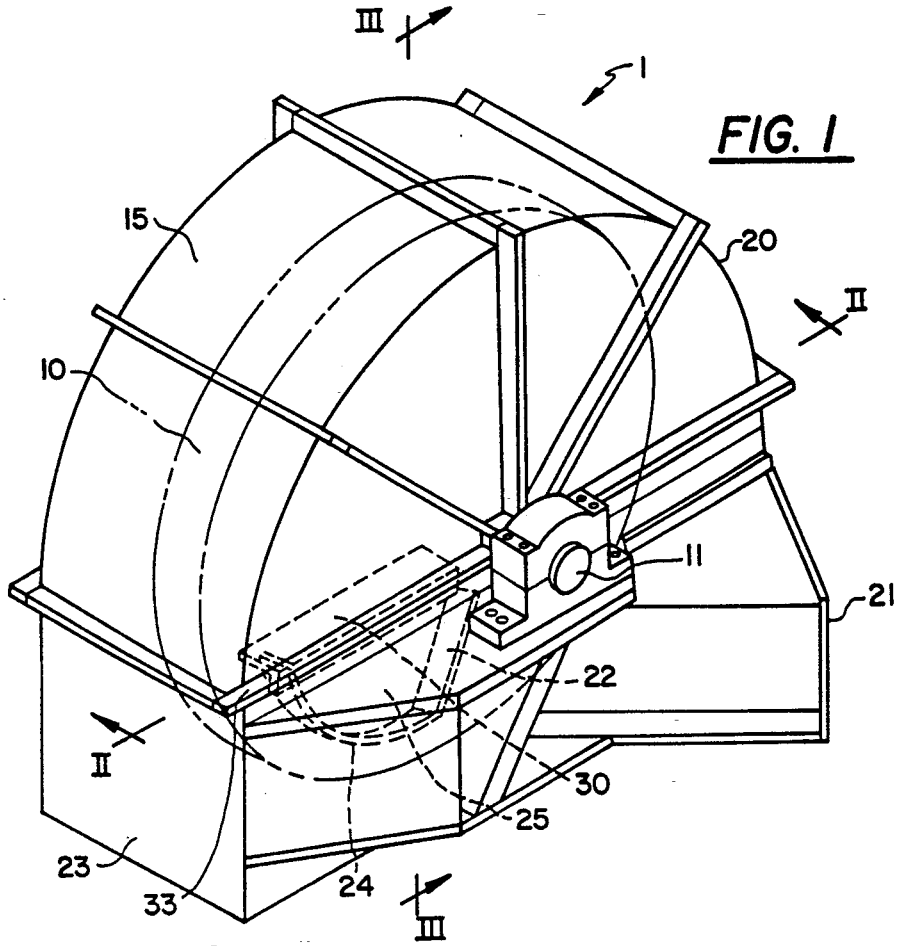
FIG. 1 is a perspective view of the wood chipping apparatus of the present invention.

The wood chipping apparatus is shown in FIGS. 1–4. The wood chipper 1, has a disk 10 which rotates about a horizontal axis 11. The disk has a number of straight, radial slots (not shown), at least some which have a cutting blade 13 attached adjacent thereto. The disk 10 is enclosed within a housing 20. The housing has an infeed chute 21 for infeeding logs into the chipper 1 to contact the disk 10. Although a horizontal chute is illustrated, the invention is also applicable to chippers having vertically inclined chutes, or chippers having more than one infeed chute. The cutting disk 10 rotates in the direction indicated by reference arrow 14.

Figure 2:
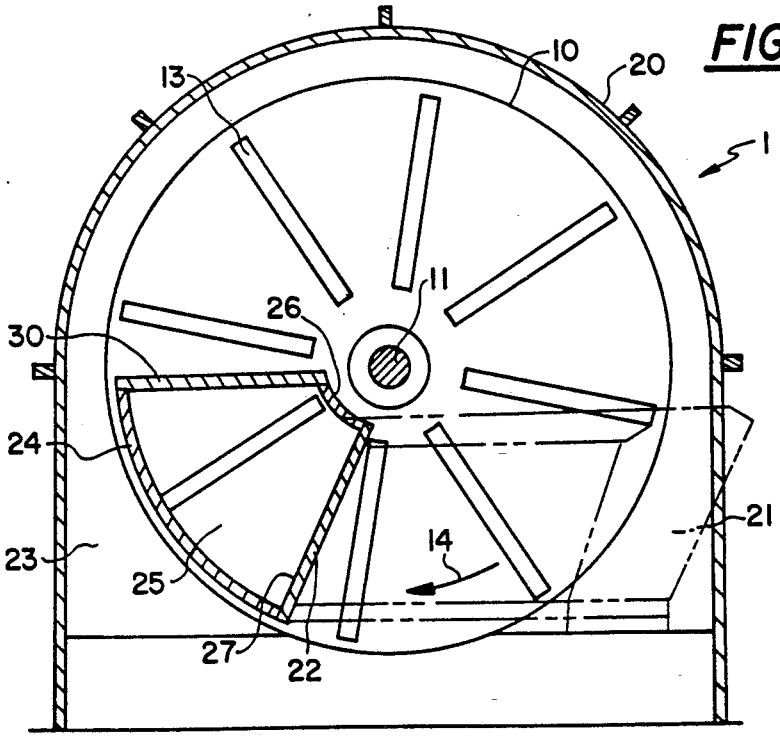
FIG. 2 is a partial cross-section taken along line II—II of FIG. 1.

Wood 50 is infed through chute 21 and abuts the disk 10. The wood is not fed perpendicular to the disk 10, but at an angle of approximately 20 to 60 degrees thereto. As wood is infed, it contacts the cutting disk 10 adjacent to the main anvil 22 as shown in FIG. 2. The main anvil 22 is attached to the interior wall of the housing 20 and extends towards the disk to define a narrow gap between the cutting blades 13 and the edge of the main anvil 22. The distance between the housing wall and the cutter disk ranges from about 2 to 8 inches. Alternatively, the main anvil is attached to an anvil support 32 which is coupled to the housing 20. Anvil 22 may be attached to the housing by welding, bolts or other attachment means known in the art, and the anvil support 22, if provided may be coupled to the housing by welding or by bolts so that the position of the anvil support, and hence anvil 22 is adjustable relative to the disk. The narrow gap between the anvil 22 and the blades 13 of the cutter disk 10 may be about 1/10,000 of an inch.

The main anvil 22 has a number of purposes. It provides a stop for wood being infed, it directs wood into the path of the cutting blades 13, and it provides an edge or counter blade against which the cutting blades 13 act. The narrow gap minimizes wear of the anvil while preventing most wood from being pulled past the anvil by the cutting blades rather than being chipped. Wood that is properly chipped is cut from the log by the chipping blade and passes through the slot in the disk to the discharge side 15 of the cutting disk 10.

As described above, with reference to conventional chippers, occasionally, when logs are being chipped, the blades 13, rather than chipping a portion of the wood, drag a portion or sliver of the wood through the main anvil/blade gap. This is particularly troublesome when a long piece of wood is being fed and a sliver breaks off along the grain. The blades continuously drag the sliver through the gap as it detaches from the log. The sliver then passes into an open portion 23 of the housing, where it passes to the discharge side 15 of the disk. Once the slivers have passed to the discharge side 15, they are discharged with the other chips to be further processed.

In accordance with the invention, to capture and chip such slivers, a second wear plate or anvil 30 is installed downstream of the main anvil 22 and an outer curved wall 24 is provided to form a substantially closed compartment 25. The compartment is bounded on the sides by the housing wall 20 and the disk 10. One end wall 27 is the back surface of the main anvil 22 and the other end wall is the second wear plate 30. The outer curved wall 24 defines the radially outer wall of the compartment. An inner curved wall 26 may also be applied to completely enclose the compartment 25, although such is not critical to capture and chip the slivers. The outer and inner curved walls 24, 26 can be made of a single member or a plurality of members, and they are preferably attached to the housing 20 by any of a number of known ways, depending on desired adjustability and replacement potential, including but not limited to bolts, intermediate supports, and welding. Alternatively, the inner and outer curved members can be attached to the disk (not shown) and extend towards the wall of the housing. In this variation, each curved member forms a continuous flange around the whole disk.

The closed compartment 25 contains the oversized slivers that are not chipped and but are pulled through the gap by the blades. Compartment 25 holds the slivers unless and until they are chipped by the rotating blades, whereafter they pass through the disk to be discharged.

Figure 5:
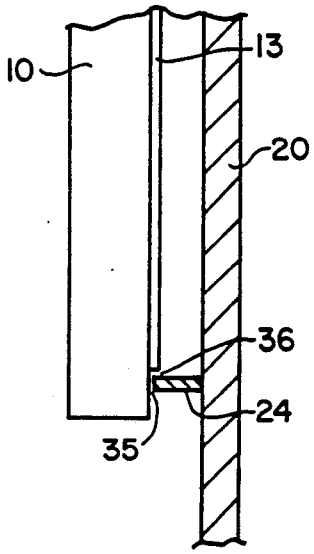
FIG. 5 is an enlarged cross-sectional view of the disk and compartment of FIG. 4 taken along line V—V.

As shown in FIG. 5, the compartment 25 extends from the inside surface of the housing wall to the blades 13 on the disk 10. Depending upon the size of the chipper, the compartment has a width of approximately 2 to 8 inches. The main anvil 22 which is one edge of the compartment is not necessarily vertical. It may be angled as shown in FIG. 2, or it may be oriented at any other angle depending upon the type of infeed, desired chipping characteristics, and the desired self-feed characteristics. For example, the main anvil could be oriented horizontally for a vertical infeed of logs.

Further, the second anvil 30 need not be horizontal, as shown. Indeed, the disposition of the second wear plate or anvil 30 depends on the orientation of the main anvil 22, the desired compartment size, an the type and configuration of the chipper. Thus, the positions of the main and second anvils 22, 30 may be selected to achieve the desired interior volume of the enclosed compartment 25, to achieve the desired location of the infeed chute 21, and to achieve the desired location of the output 40.

The outer curved wall 24 of the compartment, which forms the circumferential boundary of the compartment, is of a curved shaped to substantially follow the path of the blades 13 on the rotating disk 10. The curved wall is attached to the inside of the housing to project toward the disk from the inner wall thereof as shown in FIGS. 1 and 5. The curved wall follows the circular path of the radial end of the rotating blades and is positioned such that a very narrow radial gap 36 exists between the radial end of the blades and the inside edge of the curved wall so that the slivers cannot escape the compartment and avoid chipping. Preferably, the radial gap is on the order of about ⅛ to 1/16 of an inch. The curved wall 24 extends axially towards the surface of the disk to define a narrow axial gap 37. The axial gap between order of about ⅛ to 1/16 of an inch. Thus, the outer curved wall defines a radially outer boundary for the compartment.

Figure 3:
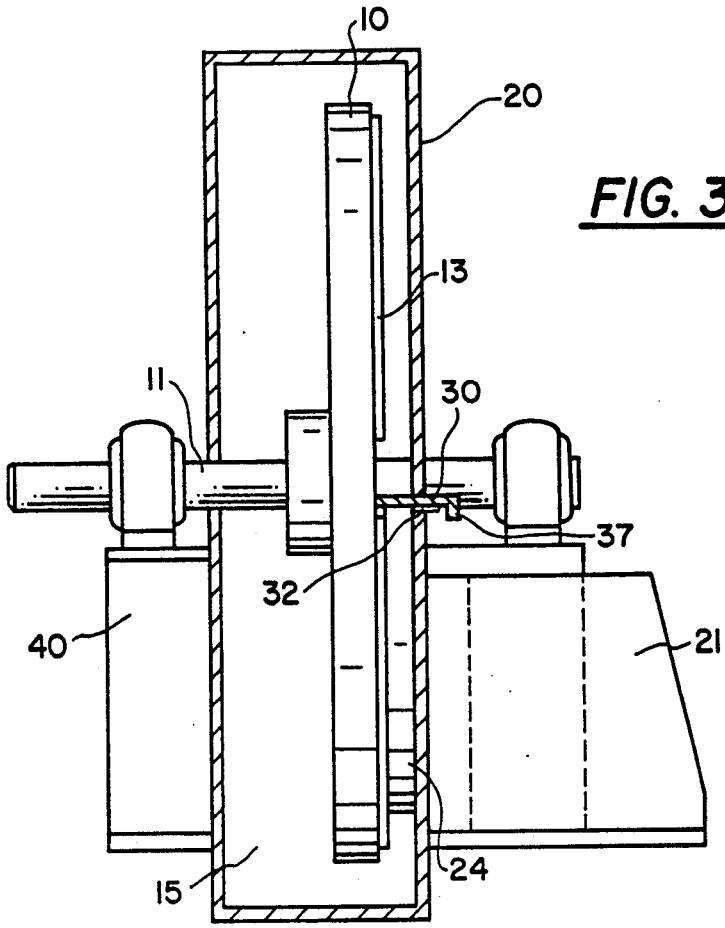
FIG. 3 is a cross-section taken along line III—III of FIG. 1.
Figure 4:
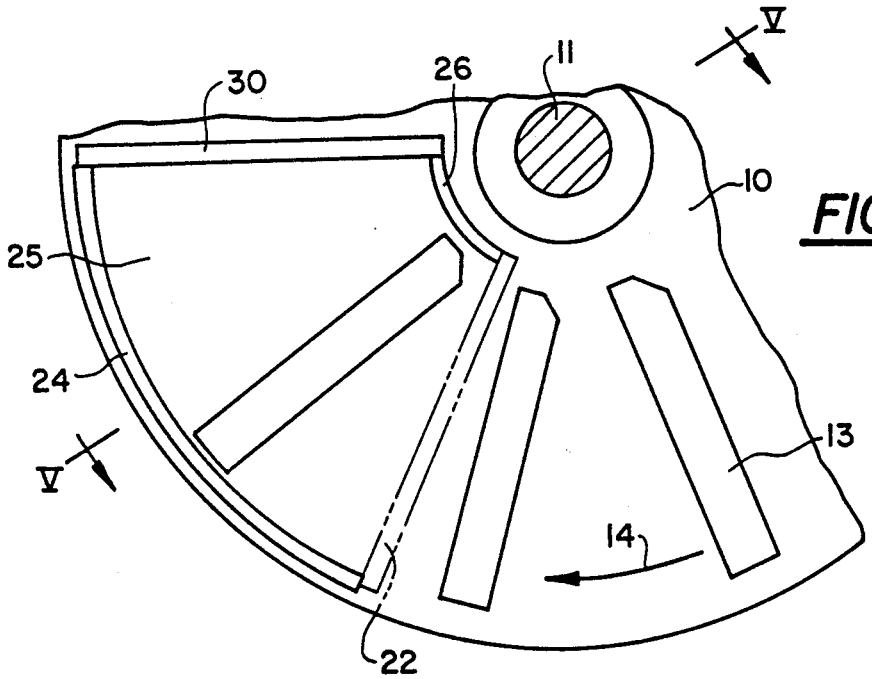
FIG. 4 is an enlarged cutaway view of the lower portion of FIG. 2.

At the top of the closed compartment 25 the second anvil 30 or wear plate is connected to the inside wall of the housing. The wear plate may be directly connected to the housing, but preferably is attached to an anvil support or wear plate support 32 as shown in FIG. 3. The anvil support 32 is attached to the housing 20 or to a frame member 33 which is attached to the housing.

The support 32 may be attached to the housing in any manner known in the art for wear plates and anvils, including with bolts, via intermediate components and/or by welding. The second anvil 30 or wear plate can be slidably attached to the support such that the second anvil 30 or wear plate is movable toward the surface of the disk 10. Although not illustrated, the anvil may be immovably attached to the housing or support.

Figure 7:
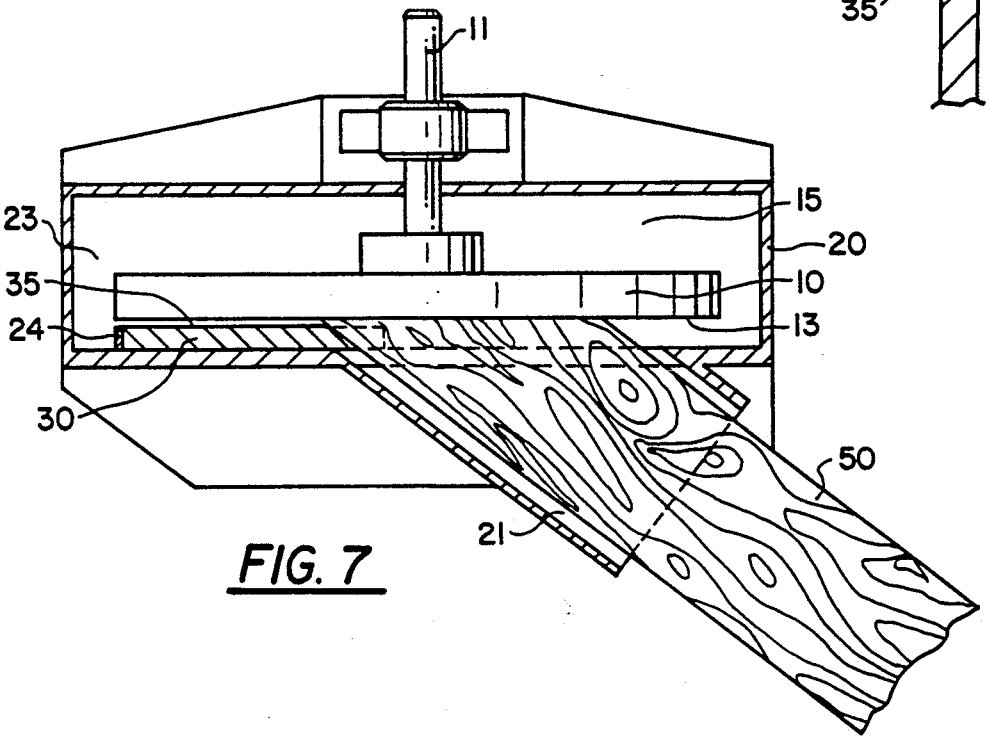
FIG. 7 is a partial cross section of FIG. 1.

As shown in FIGS. 1, 2 and 7, the second anvil 30 extends radially from near the center of the disk 10, to at least an intersection with the outer curved wall 24, thus forming an end boundary of the compartment 25. The second anvil 30 is adjustable towards the disk 10 so that as the anvil becomes worn due to contact with the blades and wood, it can be moved to define a proper gap from the disk 10.

Figure 6A:
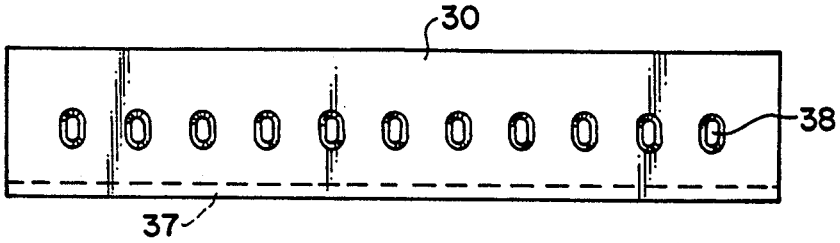
FIG. 6A is top view of the wear plate of the present invention.
Figure 6B:
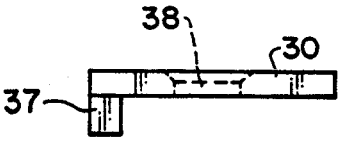
FIG. 6B is an end view of the wear plate of FIG. 6A.

As shown in FIGS. 6A and 6B, the second anvil 30 has a series of elongated holes 38. Bolts are placed through the holes and threaded into the anvil support 32. The second anvil 30 is thus adjustable to the extent of the length of the elongated slots or holes 38. For example, holes 38 one inch long would permit a nearly one inch range of adjustment. To prevent the second anvil 30 from being moved too far towards the disk 10, a stop lip 37 is welded to the back edge of the second anvil 30, as shown in FIG. 6B. The stop lip 37 is not a necessary element of the second anvil 30, but is a preferred feature as it also has the advantage of facilitating alignment of the second anvil with the blades of the cutter disk 10. When the second anvil 30 is advanced towards the disk 10, the stop lip 37 moves closer to and eventually will contact the edge of the anvil support 32 preventing a further shift of the anvil 30. When the anvil 30 has been worn down to the extent that there is no further adjustment possible, the anvil or wear plate 30 may be entirely removed and replaced with a new one.

The second anvil 30 may be adjusted so that the gap 35 between the anvil edge and the blade is approximately equal to the gap between the first anvil and the blades. Alternatively, the gap 35 can be larger because there is less likelihood that the slivers will be dragged through the second anvil gap 35 because they are not attached to a log which forces the wood to be in an orientation susceptible to being pulled through the gap 35. Instead, the slivers in the second compartment 25 are tossed about due to the air currents and contact with the adjacent moving blades 13. The gap 35 between the second anvil and the blades 13 can be continuously adjusted to be 1/64 of an inch from the disk or otherwise spaced so that the blades 13 will not contact the anvil 30. Most, preferably, the gap 35 is 1/16 to 1/64 of an inch.

The narrow gap 35 defined by the second anvil 30 and the moving cutting blades 13 provides an effective cutting interface for chipping the oversized slivers in the compartment. Due to the contact with the wood parts and occasionally with the blades 13, the anvil 30 will wear, thus necessitating adjustment and eventual replacement of the anvil 30. Instead of a second anvil, a wear plate or other member may be used to provide a boundary for the compartment. Although an anvil is preferable because of its particular cutting surface, any member will suffice which provides a rigid and straight boundary such that a narrow clearance with the blades is formed, so that when the blades pass near the member, the wood pieces trapped between the member and the blade will be chipped by the blade.

An inner radial curved wall 26 may also be installed to completely enclose the compartment. However, this wall is less important than the other boundaries because the motion of the blades and the centrifugal motion of the wood slivers within the compartment will tend to prevent slivers from escaping the compartment in the direction of the center of rotation of the disk. A radially inner curved wall 26, if applied, extends from the radially inner end of the main anvil 27 to the radially inner end of the second anvil support 32.

The above described compartment 25 traps oversized wood parts that initially avoided chipping in advance of the main anvil 22 by being pulled through the gap between the blades and the main anvil. The slivers are contained in the compartment 25 bounded by the chipper housing, the disk, the main anvil, the second anvil or wear plate and the radially outer curved wall. The slivers remain in the compartment and are subjected to a second cutting action by the blades in advance of the second anvil. The slivers are thus ultimately chipped by the blades.

The second cutting compartment of the present invention can be applied to chippers of all sizes and to chippers having a top and/or bottom discharge. Also, the second cutting compartment can be applied to chippers having more than one infeed chute. The second cutting compartment may be placed anywhere along the path of the disk and may be of any size. If more than one infeed chute is used, a plurality of second chipping compartments may be appropriate, one adjacent to and downstream of each infeed chute. To ensure further processing of slivers that may escape chipping in the compartment of the invention, a second such cutting compartment (not shown) similar to the first may be included.

The wood chipping apparatus described above provides a chipper that efficiently and consistently chips wood into appropriate sized chips. The apparatus reduces or eliminates the costly and time consuming steps of separating slivers from the acceptable chips and further processing such slivers.

While the invention has been described in connection with what are presently considered to be the most practical and preferred embodiments, it is to be understood that the invention is not to be limited to the disclosed embodiment, but on the contrary is intended to cover various modifications and equivalent arrangements included within the spirit and scope of the appended claims.

What is claimed is:

1. A wood chipping apparatus comprising:

a chipping disk;

a housing enclosing the chipping disk, said housing including first and second vertical side walls which are substantially parallel to a vertical plane of the chipper disk;

a chute attached to and extending from the housing for guiding wood to be chipped toward the disk;

a radially extending anvil operatively coupled to said first wall of said housing so as to be disposed adjacent to the chipping disk and the chute;

a radially extending wear plate operatively connected to the first wall of the housing and angularly offset from the radially extending anvil in a direction of rotation of the disk; and at least one wall member extending laterally from one of the disk and the first wall of the housing toward the other of the first wall and the disk and at least between the wear plate and the anvil so as to define, with the first wall, the disk, the wear plate and the anvil, a substantially closed compartment, such that wood pieces not chipped at or before the first anvil are captured in the compartment and subsequently chipped by the blades passing the compartment.

2. A wood chipping apparatus as in claim 1, wherein the at least one wall member is a radially outer curved wall member which forms a radially outer boundary of the compartment.

3. A wood chipping apparatus as in claim 2, wherein the wear plate and the radially outer curved wall member substantially intersect at a radially outer end of the wear plate to form the compartment.

4. A wood chipping apparatus as in claim 3, wherein at least one enclosing member is an inner curved wall member which forms a radially inner boundary of the compartment.

5. A wood chipping apparatus as in claim 2, wherein the radially outer curved wall member is attached along one edge to the housing such that the curved wall member extends towards the cutting disk.

6. A wood chipping apparatus as in claim 5, wherein a gap between an axial edge of the radially outer curved wall member and the cutting disk is in the range of about ⅛ to about 1/64 of an inch.

7. A wood chipping apparatus as in claim 1, wherein the wear plate comprises:

a support attached to the housing;

a wear plate member; and a coupling means for attaching the wear plate member to the support.

8. A wood chipping apparatus as in claim 7, wherein the coupling means is a plurality of bolts which pass through a plurality of holes in the wear plate member and are threadable into the support.

9. A wood chipping apparatus as in claim 8, wherein the holes are elongated slots such that the wear plate member is axially adjustable toward and away from the chipping disk.

10. A wood chipping apparatus as in claim 9, wherein a gap between the wear plate member and the cutting disk is in the range of about 1/16 to about 1/16 of an inch.

11. A wood chipping apparatus as in claim 10, wherein the wear plate member has a stop lip along an edge thereof remote from the cutting disk.

12. A wood chipping apparatus as in claim 1 wherein the wear plate is an anvil.

13. A wood chipping apparatus comprising:

a chipping disk rotatable about a horizontal axis, the disk having a plurality of radial through slots extending axially through the disk, the disk having a plurality of cutting blades attached thereto adjacent the through slots;

a housing enclosing the chipping disk, the housing having an infeed opening;

a radially extending anvil coupled to the housing adjacent to the infeed opening, the anvil extending in an axial direction toward the chipping disk;

a radially extending wear plate support coupled to the housing along a radius of the disk and angularly offset from the anvil in a direction of rotation of the disk;

a radially extending wear plate coupled to the wear plate support, the wear plate extending in an axial direction towards the chipping disk; and a curved wall member attached to the housing, the curved wall member extending in an arc at least from a radially outer end of the anvil at least to a radially outer end of the wear plate, the curved wall member also extending in an axial direction toward the disk, such that a chipping area is formed adjacent to, but downstream of, the anvil in a direction of rotation of the chipping disk, the chipping area being substantially enclosed by the housing, the chipping disk, the anvil, the wear plate and the curved wall member to contain and chip wood slivers which pass the anvil without being chipped by the chipping disk.

14. A wood chipping apparatus, as shown in claim 13, wherein the wear plate is adjustably coupled to the wear plate support such that the wear plate is adjustable in an axial direction toward the disk.

* * * * *